United States Patent [19]

Melone

[11] 4,448,382

[45] May 15, 1984

[54] POWER OPERATED CHAIR LIFT MECHANISM

[75] Inventor: Robert R. Melone, Rockford, Ill.

[73] Assignee: Smith Investment Company, Rockford, Ill.

[21] Appl. No.: 408,439

[22] Filed: Aug. 16, 1982

[51] Int. Cl.[3] ..... F16M 13/00

[52] U.S. Cl. ..... 248/421; 248/281.1; 297/347

[58] Field of Search ..... 248/421, 669, 188.4, 248/280.1, 281.1; 297/347, 348, 345

[56] References Cited

U.S. PATENT DOCUMENTS

| | | | |
|---|---|---|---|
| 2,156,148 | 4/1939 | Giacomo et al. | 248/421 X |
| 2,766,007 | 10/1956 | Krilanovich | 248/281.1 |
| 3,479,086 | 11/1969 | Sheridan | 297/345 |
| 3,554,598 | 1/1971 | Dunkin | 248/421 X |
| 3,698,673 | 10/1972 | Olsen | 248/421 |
| 4,173,372 | 11/1973 | Norris | 248/421 X |

FOREIGN PATENT DOCUMENTS

| | | | |
|---|---|---|---|
| 152523 | 10/1920 | United Kingdom | 297/347 |

*Primary Examiner*—J. Franklin Foss
*Assistant Examiner*—David L. Talbott
*Attorney, Agent, or Firm*—Vernon J. Pillote

[57] ABSTRACT

A power operated chair lift mechanism including long links pivotally connected at one end to a horizontally movable follower block and pivotally connected at the other end to a vertically movable chair support, and short links pivotally connected at one end intermediate the ends of the long links and at the other end to the base to form an isosceles linkage for raising and lowering the chair in response to horizontal movement of the follower block. Auxiliary links are connected to a second follower block and to vertical guideways in the chair support and are pivotally connected intermediate their ends to the short links to provide a second isosceles linkage for maintaining the chair support in a fixed attitude during raising and lowering of the chair. The chair can be rotated about an upright axis in all vertically adjusted positions.

14 Claims, 3 Drawing Figures

16
16b
16c
58
58a
A1
A2
A3
A4
A5
A6
A7
12
21
11
25
10
33
46
13
32
34
35
36
23
24
17
19
18
31
51
51a
52
55
56
26
41
42

POWER OPERATED CHAIR LIFT MECHANISM

BACKGROUND OF THE INVENTION

Power operated vertically adjustable chairs are commonly used in beauty salons, barber shops, dental offices and the like to adjust the height of the chair occupant to the operator. In some installations such as in beauty salons, it is desirable if the operator can work on the patron in the chair while the operator is seated as well as when the operator is standing. However, in order to enable the operator to work on the patron in the chair when the operator is seated, the chair lift mechanism must be capable of positioning the chair seat at a level substantially below normal chair height, for example at a height of about fourteen or fifteen inches. On the other hand, in order to enable the operator to work on the patron in the chair while the operator is standing, the chair lift mechanism must be capable of supporting the chair seat at a height substantially above normal chair height, for example a height of about twenty-six to twenty-eight inches.

SUMMARY OF THE INVENTION

It is an object of the present invention to provide a power operated chair lift mechanism which is capable of positioning a chair seat at a sufficiently low level to enable an operator to work on a patron in the chair while the operator is seated, and to also enable positioning of the chair seat at a sufficiently high level to enable the operator to work on the patron in the chair while the operator is standing, and which provides a stable support for the chair in its different vertically adjusted positions.

Another object of this invention is to provide a vertically adjustable power operated chair lift mechanism in which the chair does not shift horizontally during raising and lowering of the chair.

Accordingly, the present invention provides a power operated chair lift mechanism comprising a base having horizontal linear guide means thereon, a chair support, a first follower means mounted on the horizontal linear guide means for horizontal movement relative to the base, a first link means, means connecting one end of the first link means to the first follower means for movement therewith and for pivotal movement relative thereto about first horizontal axis, means connecting the other end of the first link means to a chair support for pivotal movement relative thereto about a second horizontal axis, a second link means, means connecting the second link means to the first link means at a location intermediate the first and second horizontal axes for pivotal movement relative thereto about a third horizontal axis, means pivotally connecting the other end of the second link means to the base for pivotal movement relative thereto about a fourth horizontal axis at a fixed location, the spacing between the third and fourth pivot axes along the second link means being equal to the spacing between the first and third pivot axes along the first link means, means engaging the chair support for maintaining the chair support in a fixed attitude relative to the horizontal as the chair support is moved vertically, and power operated means connected to the first follower means for moving the first follower means along the horizontal linear guide means to raise and lower the chair support.

The means for maintaining the chair lift support in a fixed attitude includes vertical guide means on the chair support, a second follower means on the horizontal linear guide means, a third follower means mounted on the vertical guide means for vertical movement relative to the chair support, a third link means shorter than the first link means, means connecting one end of the third link means to the second follower means for movement therewith and for pivotal movement relative thereto about a fifth horizontal axis, means connecting the other end of the third link means to the third follower means for movement therewith and for pivotal movement relative thereto about a sixth horizontal axis, and means pivotally connecting the second link means to the third link means for relative pivotal movement about a seventh horizontal axis at a location on the third link means intermediate the fifth and sixth horizontal axes and at a location on the second link means intermediate the third and fourth horizontal axes.

These, together with other objects, features and advantages of this invention will be more readily understood by reference to the following detailed description, when taken in connection with the accompanying drawings wherein.

Figure 2:
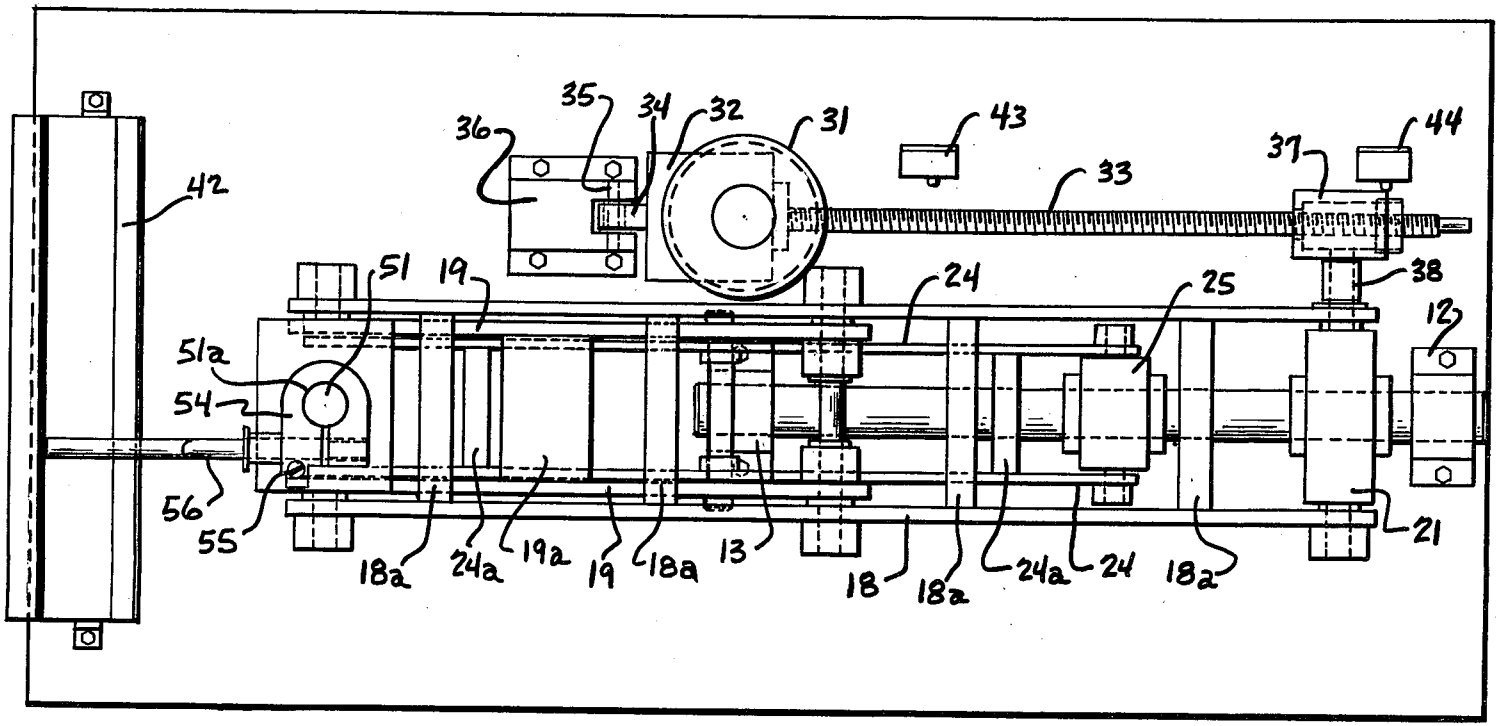
FIG. 2 is a plan view of the chair lift mechanism.
Figure 3:
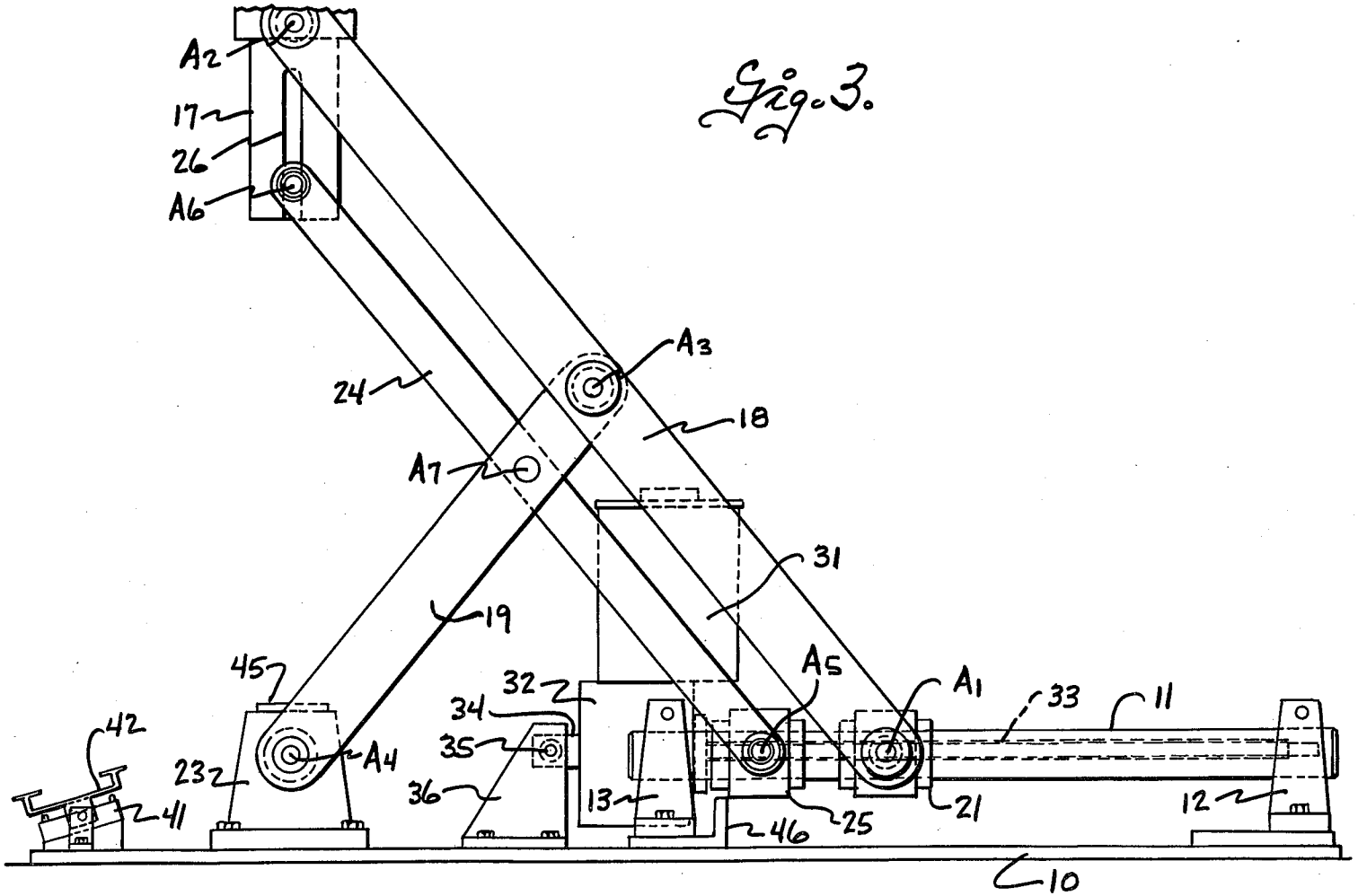
FIG. 3 is a side elevational view of the chair lift mechanism shown in its raised position.

The chair lift mechanism is supported on a generally flat base 10 and includes an elongated horizontal linear guide advantageously in the form of a guide bar 11 supported at its ends on the base by supports 12 and 13. A chair designated generally by the numeral 16 is mounted on a chair support 17, and the chair support is raised and lowered by a linkage mechanism including a pair of long links 18 and a pair of short links 19. As best shown in FIG. 2, the pair of long links 18 are advantageously rigidly interconnected at spaced points therealong by crossbars 18*a*, and the short links are similarly rigidly interconnected by a crosspiece 19*a*. A follower block 21 is supported on the guide bar 11 for sliding movement therealong and the follower block may, for example, be of the recirculating ball type to reduce friction. One end of each of the long links 18 is pivotally connected to the follower block 21 for movement therewith and for pivotal movement relative to the bearing block about a first horizontal axis $A_1$. As best shown in FIG. 2, the lower ends of the link 18 are attached to the follower block 21 at relatively opposite sides of the shaft 11 and, as will be seen from FIGS. 1 and 3, the axis $A_1$ intersects the axis of the guide bar 11. The other ends of the long links 18 are disposed at relatively opposite sides of the chair support 17 and are pivotally connected thereto for relative pivotal movement about a second horizontal axis $A_2$. The short links 19 are pivotally connected at one end to the long links 18 intermediate their ends, for relative pivotal movement about a third horizontal axis $A_3$, and the other ends of the short links 19 are disposed at opposite sides of a support 23 on the base and pivotally connected thereto for relative pivotal movement about a fourth horizontal axis $A_4$. The axis $A_4$ is disposed in the same horizontal plane as the axis $A_1$ and the spacing between the axes $A_3$ and $A_4$ is made equal to the spacing between the axes $A_1$ and $A_3$ to form an isosceles linkage. In addition, the spacing between the axes $A_4$ and $A_3$ measured along the link 19 is advantageously made the same as the spacing between the axes $A_3$ and $A_2$ measured along the long links 18 so that the axis $A_2$ is disposed in the same vertical plane as the axis $A_4$ in all vertically moved positions of the chair support 17.

Provision is made for maintaining the chair support in a fixed attitude during raising and lowering of the chair support. For this purpose, a pair of auxiliary or compensating links 24 are provided which are shorter than the long links 18, and which are advantageously rigidly interconnected with each other by crosspieces 24*a* (FIG. 2). One end of each of the auxiliary links 24 is pivotally connected to a follower block 25 that is slidable along the guide bar 11, for movement therewith and for pivotal movement relative thereto about a fifth horizontal axis $A_5$. The follower block 25 can conveniently be of the anit-friction type previously described in connection with the follower block 21 and the lower ends of the links 24 are attached to the follower block 25 at relatively opposite sides of the guide bar 11, with the horizontal axis $A_5$ extending crosswise and intersecting the axis of the guide bar. Vertical guideways 26 are provided in the chair support 17, and the other ends of the auxiliary links 24 are pivotally connected to followers (not shown) that are slidable along the guideways 26, for movement along the guideways and for pivotal movement about a sixth horizontal pivot axis $A_6$. The guideways 26 can conveniently comprise vertically elongated slots in opposite sides of the chair support 17 and the followers comprise bearing block of a wear-resistant low friction material that is slidable along the guideways 26. The auxiliary links 24 are also pivotally connected intermediate their ends to the short links 19 intermediate the ends of the latter for relative pivotal movement about a seventh horizontal pivot axis $A_7$. The pivot axis $A_7$ is spaced along the links 19 from the pivot axis $A_4$ a distance equal to the spacing of the axis $A_7$ along the links 24 from the pivot axis $A_5$, to form a second isosceles linkage. The spacing along the links 24 between the axes $A_6$ and $A_7$ is also preferably made equal to the spacing along the links 19 between the axis $A_4$ and $A_7$ and the vertical guideways on the chair support 26 are located such that the pivot axis $A_6$ is disposed in a vertical plane through the axes $A_2$ and $A_4$.

A power operated means is provided for moving the follower block 21 along the guide bar 11 to raise and lower the chair. The power operated means includes a reversible electric motor 31 that is connected through a gear box 32 to a horizontally disposed worm shaft 33. The drive motor and gear box are mounted as by an ear 34 and pin 35 on a bracket 36 secured to the base, with the screw shaft 33 extending parallel to and alongside the guide bar 11. A screw follower or nut 37 (FIG. 2) is mounted on the screw shaft and connected as indicated at 38 to the follower block 21. With this arrangement, the follower block 21 is moved in one direction along the guide bar 11 when the motor 31 drives the screw shaft 33 in one direction, and the follower block 21 moved in the opposite direction along the guide bar 11 when the motor drives the screw shaft 33 in the opposite direction. The motor 31 is reversibly operated under the control of a foot switch 41 conveniently operated by a treadle 42, and limit switches 43 and 44 actuated by the screw drive mechanism are provided to interrupt energization of the motor when the screw follower 37 reaches either of its travel limits. The limit switches 43 and 44 are commonly built into the screw shaft drive but are herein diagrammatically shown mounted alongside the path of travel of the screw follower 37. In general, switch 41 is operable under the control of the treadle 42 to energize the motor 31 in one direction to raise the chair support and, when the treadle 42 is moved to its intermediate position, the motor is de-energized and the screw and follower will hold the chair in the adjusted position. If the treadle is held down until the chair reaches its fully raised position, one of the limit switches 43 is operated to de-energize the motor. When the treadle is moved in the other direction it operates switch 41 to drive the motor in the opposite direction until the treadle is either moved back to its mid position or the follower 37 engages the other limit switch 44 to again de-energize the motor. Mechanical stops are also provided to limit raising and lowering of the chair. A lower chair stop 45 comprises a resilient pad on the link support 23 arranged to engage the lower end of the chair support 17 should a malfunction cause the chair to travel beyond its normal lowest position. An upper chair stop 46 comprises a bracket mounted on the base at a location to engage follower block 25, should a malfunction cause the chair to travel beyond its normal highest position shown in FIG. 3.

The chair 16 is advantageously mounted on the chair support for turning movement about an upright axis to enable rotation of the chair. For this purpose, a spindle 51 (FIG. 2) is mounted as by radial and thrust bearings (not shown) for rotation about an upright axis on the chair support 17. The spindle 51 has a portion 51*a* that extends above the top of the chair support 17 and the chair 16 is secured as by a mounting bracket 52 to the upper end 51*a* of the spindle for turning movement as a unit therewith. A split ring type brake 54 surrounds the portion 51*a* of the spindle and is nonrotatably secured to the chair support 17 by a fastener 55 (FIG. 2). The brake 54 normally loosely surrounds the spindle and a threaded brake actuator operated by a handle 56 is provided for drawing the ends of the split ring toward each other to apply the brake and lock the chair in an angularly adjusted position.

Figure 1:
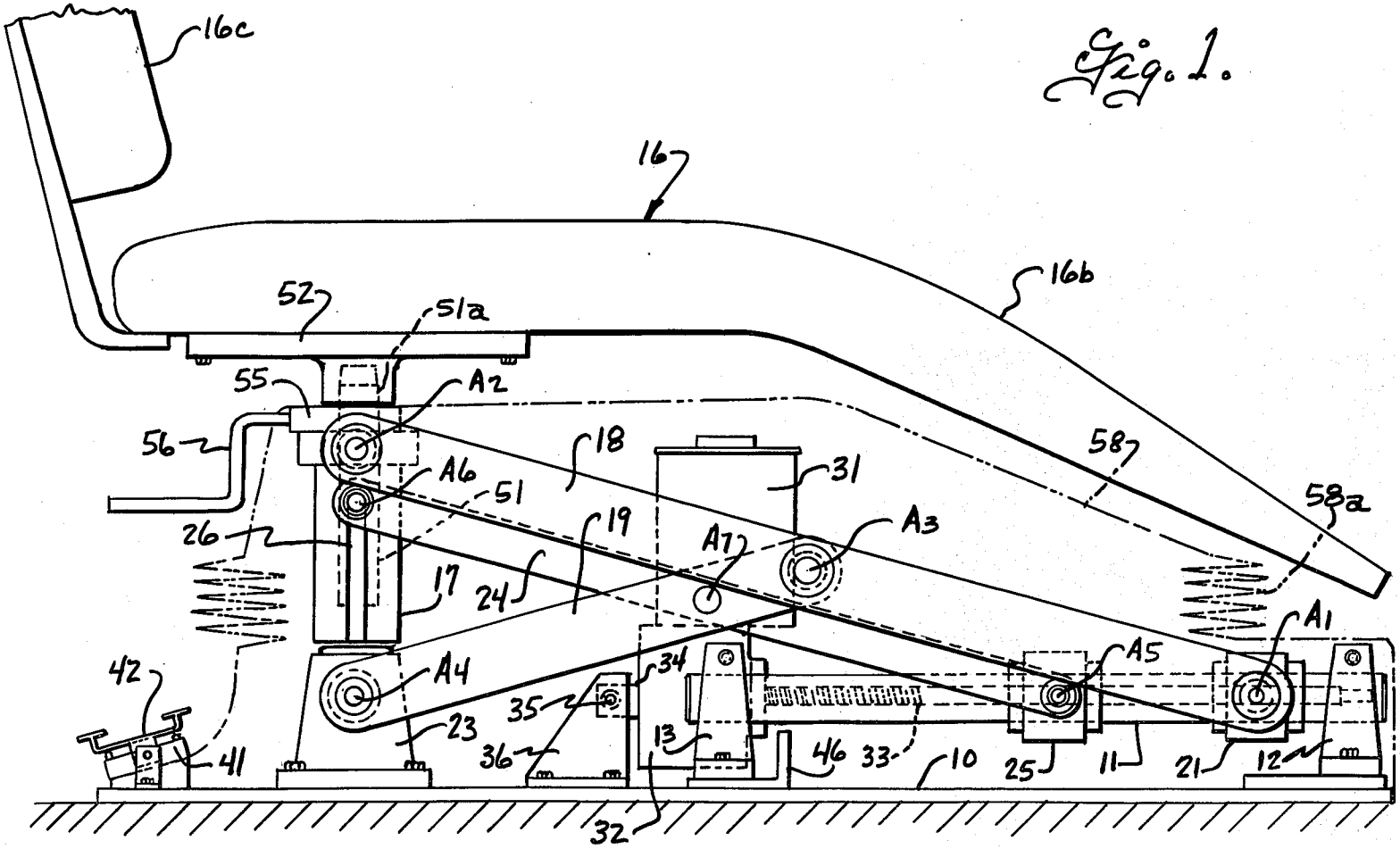
FIG. 1 is a side elevational view of a power operated chair embodying the present invention and showing the chair lift mechanism in its lowered position.

As shown in FIG. 1, the chair includes a seat portion 16*a* and a leg support portion 16*b* that is inclined downwardly from the forward end of the seat portion to underlie and support the legs of the patron. A backrest 16*c* is provided at the rear edge of the seat. In the embodiment shown, the backrest is rigidly fixed to the seat, it being understood that the backrest could be made angularly adjustable to change its position relative to the seat if desired. In addition, the leg support portion 16*b* is herein shown formed rigidly with the seat, it being understood that the leg support portion could also be made angularly adjustable to raise and/or lower the patron's legs in different positions of the seat, if desired. The chair lift mechanism is advantageously enclosed for esthetic and safety reasons and may, for example, be enclosed in a shroud 58 diagrammatically shown in broken lines in FIG. 1 and having bellows-type folds or corrugations 58*a* to allow vertical expansion and contraction of the shroud during raising and lowering of the chair.

From the foregoing it is thought that the construction and operation of the power operated chair lift mechanism will be readily understood. The long links 18 and short links 19 are connected to form an isosceles linkage for raising and lowering the chair in response to horizontal movement of the follower block 21 along the guide bar 11 under the control of the reversible drive motor 31. The auxiliary links 24 are connected to the short links 19 and to the follower block 25 on guide bar 11 and to the follower that engages the vertical guideway 26 on the chair support, to form a second isosceles linkage for maintaining the chair in a fixed attitude during raising and lowering of the chair. The chair is adjustable to low chair height, for example about fourteen or fifteen inches, and which is sufficiently below the normal chair height to allow an operator to work on a patron in the chair when the operator is seated. The chair can also be raised to a relatively high chair height, for example about twenty-six to twenty-eight inches, so that an operator can work on a patron in the chair while the operator is standing. Further, the chair can be turned about an upright axis to change the angular position of the patron in any of the vertically adjusted positions.

The embodiments of the invention in which an exclusive property or privilege is claimed are defined as follows:

1. A power operated chair lift mechanism comprising, a base having horizontal linear guide means thereon, a chair support, a first follower means mounted on the horizontal linear guide means for horizontal movement relative to the base, first link means, means connecting one end of the first link means to said first follower means for movement therewith and for pivotal movement relative thereto about a first horizontal axis, means connecting the other end of the first link means to the chair support for pivotal movement relative thereto about a second horizontal axis, a second link means, means connecting one end of the second link means to the first link means at a location intermediate the first and second horizontal axes for pivotal movement relative thereto about a third horizontal axis, means pivotally connecting the other end of the second link means to the base for pivotal movement relative thereto about a fourth horizontal axis at a fixed location, the spacing between the third and fourth horizontal axes along the second link means being equal to the spacing between the first and third horizontal axes along the first link means, means engaging said chair support for maintaining the chair support in a fixed attitude relative to the horizontal as the chair support is moved vertically, and power operated means connected to said first follower means for moving the first follower means along the horizontal linear guide means to raise and lower the chair support, said means for maintaining said chair support in a fixed attitude including, vertical guide means on the chair support, a second follower means on said horizontal linear guide means, a third follower means mounted on the vertical guide means for vertical movement relative to the chair support, a third link means shorter than said first link means, means connecting one end of said third link means to said second follower means for movement therewith and for pivotal movement relative thereto about a fifth horizontal axis, means connecting the other end of said third link means to said third follower means for movement therewith and for pivotal movement about a sixth horizontal axis, and means pivotally connecting said second link means to said third link means for relative pivotal movement about a seventh horizontal axis at a location on said third link means intermediate said fifth and sixth horizontal axes and at a location on said second link means intermediate said third and fourth horizontal axes.

2. A power operated chair lift mechanism comprising a base having horizontal linear guide means thereon, a chair support having vertical guide means thereon, a first follower means mounted on the horizontal linear guide means for horizontal movement relative to the base, a second follower means mounted on the horizontal guide means for horizontal movement relative to the base and relative to the first follower means, a third follower means mounted on said vertical guide means for vertical movement relative to the chair support, first link means, means connecting one end of the first link means to said first follower means for movement therewith and for pivotal movement relative thereto about a first horizontal axis, means connecting the other end of the first link means to the chair support for pivotal movement relative thereto about a second horizontal axis, a second link means, means pivotally connecting one end of the second link means to the first link means at a location intermediate said first and second horizontal axes for pivotal movement relative thereto about a third horizontal axis, means pivotally connecting the other end of said second link means to said base for pivotal movement relative thereto about a fourth horizontal axis at a fixed location in the same vertical plane as the second horizontal axis, the spacing between the third and fourth horizontal axes along the second link being equal to the spacing between the first and third horizontal axes along the first link means, a third link means shorter than said first link means and extending parallel thereto, means connecting one end of said third link means to said second follower means for movement therewith and for pivotal movement relative thereto about a fifth horizontal axis, means connecting the other end of said third link means to said third follower means for movement therewith and for pivotal movement about a sixth horizontal axis vertically below said second horizontal axis, means pivotally connecting said second link means to said third link means for relative pivotal movement about a seventh horizontal axis at a location on said third link means intermediate said fifth and sixth horizontal axes and at a location on said second link means intermediate said third and fourth horizontal axes, and power operated means connected to said first follower means for moving the first follower means along the horizontal linear guide means.

3. A power operated chair lift mechanism according to claim 2 wherein said third horizontal axis is equidistant from said first and second horizontal axes.

4. A power operated chair lift mechanism according to claim 3 wherein said seventh horizontal axis is equidistant from said fifth and sixth horizontal axes.

5. A power operated chair lift mechanism according to claim 2 wherein said first, second and third link means each comprise a pair of links.

6. A power operated chair lift mechanism according to claim 2 wherein said horizontal guide means comprises a guide rod mounted on the base, said first, second and third link means each comprising a pair of links with the links of each pair disposed in vertical planes at relatively opposite sides of said guide rod.

7. A power operated chair lift mechanism according to claim 2 including means for mounting a chair on said chair support for angular movement relative thereto about an upright axis.

8. A power operated chair lift mechanism according to claim 2 including brake means operable to lock the chair against turning relative to the chair support.

9. A power operated chair lift mechanism according to claim 2 wherein said power means includes a lead screw paralleling said horizontal guide means, motor means for reversibly rotating the lead screw, and a lead screw follower on the lead screw and connected to said first follower means.

10. A power operated chair lift mechanism according to claim 2 wherein said vertical guide means includes a vertically elongated recess in said chair support, said third follower means including a follower pin extending into said recess.

11. A power operated chair lift mechanism comprising, a base having a horizontal guide rod mounted thereon, first and second followers slidably mounted on the guide rod for horizontal movement relative to the base, a seat support having vertical guide means thereon, a third follower means mounted in said vertical guide means for vertical movement relative to the seat support, a first pair of links, means connecting one end of each of said first pair of links to said first follower means at relatively opposite sides of said guide rod for movement with the first follower means and for pivotal movement relative to the first follower means about a first horizontal axis, means connecting the other end of each of the first pair of links to the chair support for pivotal movement relative thereto about a second horizontal axis, a second pair of links, means pivotally connecting one end of each of the second pair of links to the first pair of links at a location equidistant from said first and second horizontal axes for pivotal movement relative thereto about a third horizontal axis, means pivotally connecting the other end of each of the second pair of links to the base for pivotal movement relative to the base about a fourth horizontal axis at a fixed location in the same vertical plane as the second horizontal axis, the spacing between the third and fourth horizontal axes along the second pair of links being equal to the spacing between the first and third horizontal axes along the first pair of links, a third pair of links shorter than said first pair of links and extending parallel thereto, means connecting one end of each of said third pair of links to said second follower means at relatively opposite sides of the guide rod for movement with the second follower means and for pivotal movement relative to the second follower means about a fifth horizontal axis, means connecting the other end of each of the third pair of links to said third follower means for movement with the third follower means and for pivotal movement about a sixth horizontal axis, means pivotally connecting the second pair of links to the third pair of links for relative pivotal movement about a seventh horizontal axis at a location on said third pair of links equidistant from the fifth and sixth horizontal axes and at a location on said second pair of links intermediate said third and fourth horizontal axes, and power operated means connected to said first follower means for moving the same along the horizontal guide rod.

12. A power operated chair lift mechanism according to claim 11 wherein said power means includes a worm shaft paralleling said guide rod, motor means for reversibly driving said worm shaft, and a worm follower on the worm shaft and connected to said first follower means.

13. A power operated chair lift mechanism according to claim 11 including means for mounting a chair on the chair support for angular movement relative thereto about an upright axis.

14. A power operated chair lift mechanism according to claim 11 wherein said vertical guide means includes vertically elongated recesses in opposite sides of said chair support, said third follower means including a follower pin on the other end of each of said first pairs of links extending into a respective one of said recesses.

* * * * *